US008733313B2

(12) United States Patent
Sato et al.

(10) Patent No.: US 8,733,313 B2
(45) Date of Patent: May 27, 2014

(54) IRON-BASED SINTERED ALLOY FOR VALVE SEAT, AND VALVE SEAT FOR INTERNAL COMBUSTION ENGINE

(75) Inventors: Kenichi Sato, Shimotsuga-gun (JP); Hiroshi Oshige, Shimotsuga-gun (JP); Takeshi Haniu, Shimotsuga-gun (JP)

(73) Assignee: Nippon Piston Ring Co., Ltd., Saitama (JP)

( * ) Notice: Subject to any disclaimer, the term of this patent is extended or adjusted under 35 U.S.C. 154(b) by 299 days.

(21) Appl. No.: 12/935,408

(22) PCT Filed: Mar. 25, 2009

(86) PCT No.: PCT/JP2009/055982

§ 371 (c)(1), (2), (4) Date: Sep. 29, 2010

(87) PCT Pub. No.: WO2009/122985

PCT Pub. Date: Oct. 8, 2009

(65) Prior Publication Data

US 2011/0023808 A1 Feb. 3, 2011

(30) Foreign Application Priority Data

Mar. 31, 2008 (JP) ..... 2008-093436

(51) Int. Cl.
*F01L 3/00* (2006.01)

(52) U.S. Cl.
USPC ..... 123/188.8; 75/228; 75/233; 419/14; 419/10

(58) Field of Classification Search
CPC ..... C22C 1/0491; F01L 2101/00; F01L 3/02
USPC ..... 123/188.9, 188.8, 188.3, 506; 75/246, 75/244, 231, 241, 228; 419/38, 27, 11
See application file for complete search history.

(56) References Cited

U.S. PATENT DOCUMENTS 4,204,031 A * 5/1980 Takemura et al. ..... 428/539.5
5,031,878 A * 7/1991 Ishikawa et al. ..... 251/368

(Continued)

FOREIGN PATENT DOCUMENTS

JP 49-028508 A 3/1974
JP 10-226855 A 8/1998

(Continued)

*Primary Examiner* — Noah Kamen
*Assistant Examiner* — Long T Tran
(74) *Attorney, Agent, or Firm* — Crowell & Moring LLP

(57) ABSTRACT

It is an object of the present invention to provide a valve seat product in which the amount of hard particles added to improve the wear resistance of a valve seat of an internal combustion engine is increased, and is excellent in the mechanical strength and machinability. In order to achieve the object, an iron-based sintered alloy material for a valve seat is employed which is made to contain a first hard particle having an average primary particle diameter of 5 to 20 μm and a second hard particle having an average primary particle diameter of 20 to 150 μm in a texture, wherein a particle size distribution curve measured by laser diffraction scattering analysis has N peaks (N is an integer equal to or larger than 2) and when particle diameters corresponding to the peak top positions are denoted as $D_{T1}$ to $D_{TN}$, a peak top particle diameter difference between neighboring $D_{Tn-1}$ and $D_{Tn}$ ($|D_{Tn-1}-D_{Tn}|$: n is an integer equal to or larger than 2 and equal to or smaller than N) is in the range of 15 to 100 μm in at least one neighboring $D_{Tn-1}$ and $D_{Tn}$; and the total area ratio occupied by both of the first hard particle and the second hard particle constituting the mixed hard particle in the texture of the iron-based sintered alloy is 10 to 60% by area.

6 Claims, 6 Drawing Sheets

(56) References Cited

U.S. PATENT DOCUMENTS

| | | | | |
|---|---|---|---|---|
| 5,529,602 | A * | 6/1996 | Ishii et al. | 75/231 |
| 5,759,227 | A * | 6/1998 | Takahashi et al. | 75/246 |
| 5,843,243 | A * | 12/1998 | Kawasaki et al. | 148/435 |
| 5,858,056 | A * | 1/1999 | Fujine et al. | 75/236 |
| 6,436,338 | B1 * | 8/2002 | Qiao | 420/69 |
| 6,526,949 | B2 * | 3/2003 | Murakami et al. | 123/506 |
| 6,676,724 | B1 * | 1/2004 | Narasimhan et al. | 75/243 |
| 6,793,876 | B2 * | 9/2004 | Kawakami et al. | 419/27 |
| 7,144,440 | B2 * | 12/2006 | Ando | 75/255 |
| 7,273,508 | B2 * | 9/2007 | Sato et al. | 75/243 |
| 7,578,866 | B2 * | 8/2009 | Kawase et al. | 75/233 |
| 2006/0108029 | A1 * | 5/2006 | Kawasaki et al. | 148/435 |
| 2009/0165595 | A1 * | 7/2009 | Yamamoto et al. | 75/243 |

FOREIGN PATENT DOCUMENTS

| | | | |
|---|---|---|---|
| JP | 2001-220606 | A | 8/2001 |
| JP | 2004-115897 | A | 4/2004 |
| JP | 2005-248234 | A | 9/2005 |
| JP | 2007-107660 | A | 4/2007 |

* cited by examiner

IRON-BASED SINTERED ALLOY FOR VALVE SEAT, AND VALVE SEAT FOR INTERNAL COMBUSTION ENGINE

TECHNICAL FIELD

The present invention relates to an iron-based sintered alloy material suitable for a valve seat of an internal combustion engine, and particularly to an improvement in the mechanical strength and the machinability of an iron-based sintered alloy material.

BACKGROUND ART

The valve seat is a portion serving as a valve seat for an intake valve or an exhaust valve necessary for keeping a combustion chamber airtight in contact with a valve face. Major functions of a valve seat include (1) an airtight function, i.e. prevention of a compressed gas or a combustion gas from leaking to a manifold, (2) a thermal conduction function, i.e. releasing of the heat from a valve to a cylinder head, and (3) a wear resistance function, i.e. resistant against to a collision in a valve seating and an wear in an high temperature and a high load situation. In addition, characteristics required on a valve seat include (1) low opposite aggressivility on a valve face, (2) reasonable price, and (3) easy machinability. Therefore an iron-based sintered alloy material is applied to a valve seat of an internal combustion engine to satisfy the above-mentioned functions and characteristics.

An iron-based sintered alloy material is obtained by the compression moulding in which a metal powder or the like is put into a metal mould followed by heating of the powder mould at a temperature equal to or lower than the melting point, and will be subjected to a heat treatment or otherwise if required. The iron-based sintered alloy material is made advantageous by containing suitable amounts of carbon, copper, nickel and the like in addition to iron as a main component in (1) mechanical properties, wear resistance, heat resistance and the like are improved by elements mixed in order to improve wear resistance of a sintered alloy, (2) machinability of a product is improved, (3) cost reduction by improved productivity is achieved, and the else.

However, specifications required on the materials for constituting automobile parts have been made severe year by year as well as to other various machines, i.e. further improvement on mechanical characteristics, workability such as machinability and stabile productivity and reduction of manufacturing cost are required. As for a valve seat, it is not exceptional and valve seats for internal combustion engines having better characteristics than mechanical characteristics of conventional valve seats for internal combustion engines have been required.

As response to such requirements, Patent Document 1 discloses a valve seat excellent in wear resistance with made poor opposite aggressivility to a valve face in which 10 to 20% by area in area ratio of a first hard particle which is a cobalt-based intermetallic compound particle having a particle diameter of 10 to 150 μm and of a hardness equal to or higher than 500HV0.1 and less than 800HV0.1 is made to included, and 15 to 35% by area in area ratio of a second hard particle which is a cobalt-based intermetallic compound particle having a particle diameter of 10 to 150 μm and a hardness equal to or higher than 800HV0.1 and less than 1100HV0.1, and make the total area ratio occupied by the both dispersed in an iron matrix to be 25 to 55% by area.

[Patent Document 1] Japanese Patent Laid-Open No. 2005-248234

DISCLOSURE OF THE INVENTION

Problems to be Solved by the Invention

However, even the combination of the cobalt-based intermetallic compound particles described in the conventional technology is applied and when an iron-based sintered alloy dispersed with the compound in an iron matrix is used for a valve seat of an internal combustion engine, wear resistance required for internal combustion engines never be achieved without adding a large amount of the hard particles, i.e. the large amount of the hard particles added is required to increase the wear resistance. As a result, the drawbacks caused by increasing of the amount of the hard particles added to the iron-based sintered alloy, poor toughness of the iron-based sintered alloy, increased opposite aggressivility to a valve face, and poor machinability.

For example, Patent Document 1 discloses a combination of two types of hard particles to be made disperse in an iron matrix, one of which is "a cobalt-based intermetallic compound particle performing a low opposite aggressivility and having a particle diameter of 10 to 150 μm" and the other of which is "a cobalt-based intermetallic compound particle having a increased hardness and an excellent wear resistance and having a particle diameter of 10 to 150 μm". When an iron-based sintered alloy disclosed in Patent Document 1 is used as a valve seat, an effect to satisfy both improved wear resistance of the valve seat and decreased partner opposite aggressivility. However, the drawback that it is hard to satisfy all of the wear resistance, mechanical strength and machinability in the valve seat may have sometime arose.

As described above, a long life, a high power and an improved fuel consumption efficiency are strongly required for an internal combustion engines represented by automobile engines, and an iron-based sintered alloy material for a valve seat has been required not only the wear resistance and decreased partner opposite aggressivility of the valve seat, which have an influence on the performance stability of the internal combustion engines but also improved wear resistance, mechanical strength and machinability of a valve seat.

The present invention described later has been achieved in consideration of problems in a conventional technology, and an object is to provide a product in which the amount of hard particles added to improve the wear resistance of a valve seat of an internal combustion engine is increased but excellent balance in mechanical strength and machinability of the valve seat are achieved.

Means for Solving the Problems

Then, to solve the above-mentioned problems, the present inventors have paid attention to the particle size distribution and the hardness of two types of hard particles dispersed in a texture of an iron-based sintered alloy material for a valve seat, and have studied the influence of a difference in peak top positions of the particle sizes in the particle size distribution curves on functions and characteristics of the valve seat. As a result, the present inventors have thought out that the specifications on a difference in particle sizes at peak tops of the particle size distribution curves in two types of hard particles, a content of the hard particles, and a difference in hardnesses can be a solution of the above-mentioned problems.

The iron-based sintered alloy material for a valve seat according to the present invention is an iron-based sintered alloy material comprising two types of hard particles, a first hard particle and a second hard particle dispersed in an iron-based sintered alloy matrix, wherein the iron-based sintered alloy material for a valve seat selectively uses the two types of hard particles, a first hard particle and a second hard particle which satisfies all of conditions 1 to 4 described below.

Condition 1: as for the first hard particle, the hard particle having an average primary particle diameter of 5 to 20 μm is used;

Condition 2: as for the second hard particle, the hard particle having an average primary particle diameter of 20 to 150 μm is used;

Condition 3: in the mixed hard particle obtained by mixing the two types of hard particles, a first hard particle and a second hard particle, a particle size distribution curve measured by laser diffraction scattering analysis has N peaks (N is an integer equal to or larger than 2) and when particle diameters corresponding to the peak top positions are denoted as $D_{T1}$ to $D_{TN}$, a peak top particle diameter difference between at least one neighboring $D_{Tn-1}$ and $D_{Tn}$ ($|D_{Tn-1}-D_{Tn}|$: n is an integer equal to or larger than 2 and equal to or smaller than N) is in the range of 15 to 100 μm in at least one neighboring $D_{T1-1}$ and $D_{Tn}$; and Condition 4: the total area ratio occupied by both the first hard particle and the second hard particle constituting the mixed hard particle in the texture of the iron-based sintered alloy material is 10 to 60% by area.

In the iron-based sintered alloy material for a valve seat according to the present invention, the first hard particle and the second hard particle are preferable to be a hard particle having a Vickers Hardness in the range of 650HV0.1 to 1100HV0.1.

In the iron-based sintered alloy material for a valve seat according to the present invention, the first hard particle and the second hard particle are preferable to comprise any composition selected from cobalt-based intermetallic compound composition 1, cobalt-based intermetallic compound composition 2 and an iron-based intermetallic compound composition described below.

[Cobalt-Based Intermetallic Compound Composition 1]

Silicon: 0.5 to 4.0% by weight
Chromium: 5.0 to 20.0% by weight
Molybdenum: 20.0 to 40.0% by weight
The balance: cobalt and inevitable impurities

[Cobalt-Based Intermetallic Compound Composition 2]

Silicon: 0 to 4.0% by weight
Nickel: 5.0 to 20.0% by weight
Chromium: 15.0 to 35.0% by weight
Molybdenum: 15.0 to 35.0% by weight
The balance: cobalt and inevitable impurities

[Iron-Based Intermetallic Compound Composition]

Cobalt: 10.0 to 20.0% by weight
Nickel: 2.0 to 20.0% by weight
Chromium: 12.0 to 35.0% by weight
Molybdenum: 12.0 to 35.0% by weight
The balance: iron and inevitable impurities In the iron-based sintered alloy material for a valve seat according to the present invention, the iron-based sintered alloy material contains two or more alloying constituents selected from carbon, silicon, chromium, molybdenum, cobalt, nickel, copper, tungsten and vanadium, in the range of 13.0 to 90.0% by weight in the texture.

In the iron-based sintered alloy material for a valve seat according to the present invention, the texture of the iron-based sintered alloy material is preferable to comprises a solid lubricant powder of a sulfide or a fluoride in the range of 0.2 to 5.0% by area against to 100% by area of the area ratio occupied by a first hard particle, a second hard particle and a matrix.

The valve seat of an internal combustion engine according to the present invention is characterized in that it is manufactured by using the above-mentioned iron-based sintered alloy material for a valve seat. In addition, the iron-based sintered alloy material can additionally be applied to various types of mechanical parts, bearing parts, parts for electric contacts and parts for wear resistance.

Advantages of the Invention

In the iron-based sintered alloy material for a valve seat according to the present invention, even if the amount of a hard particle added to an iron-based sintered alloy material used for manufacture of a valve seat is increased in order to improve the wear resistance of the valve seat of an internal combustion engine, preferable wear resistance, mechanical strength and machinability withstanding severe use conditions of the internal combustion engine can be maintained in well balance. Therefore, in the valve seat obtained by using the iron-based sintered alloy material for a valve seat, a good worked surface by machining can be formed and the improved airtight interior for a combustion chamber when a valve is seated can be provided. Moreover, since the iron-based sintered alloy material for a valve seat according to the present invention has a sufficient strength as a valve seat, the requirement of a long life as an internal combustion engine can be achieved.

BEST MODE FOR CARRYING OUT THE INVENTION

Hereinafter, an embodiment of the iron-based sintered alloy material for a valve seat according to the present invention will be described.

The iron-based sintered alloy material for a valve seat according to the present invention is an iron-based sintered alloy material in which two types of hard particles, a first hard particle and a second hard particle dispersed in a matrix of an iron-based sintered alloy, and is characterized in that the two types of hard particles, a first hard particle and a second hard particle which satisfies all of conditions 1 to 4 described below are selectively used.

The condition 1 preferably uses a hard particle having an average primary particle diameter of 5 to 20 μm as a first hard particle, and the condition 2 preferably uses a hard particle having an average primary particle diameter of 20 to 150 μm as a second hard particle. That is, the iron-based sintered alloy material for a valve seat according to the present invention is obtained by dispersing a mixed hard particle of two types, a first hard particle having an average primary particle diameter of 5 to 20 μm and a second hard particle having an average primary particle diameter of 20 to 150 μm, in a matrix of an iron-based sintered alloy. By applying the combination of the first hard particle and the second hard particle having such a particle diameter range, a sintered material in a suitable state as the iron-based sintered alloy material according to the present invention can be obtained. Therefore, in When an iron-based sintered alloy material is manufactured by using just a first hard particle, particles may tends to aggregate because the average primary particle diameter is as fine as 5 μm to 20 μm to make the effect of a hard particle perform hard, and raise the manufacturing cost. So, it is not preferable. In contrast, in When an iron-based sintered alloy material is manufactured by using just a second hard particle, the opposite aggressivility to a valve face is increased because the average primary particle diameter is as large as 20 μm to 150 μm, and further, the manufacturing cost is raised by carrying out longer sintering time due to the difficulty in the sintering of particles in a sintering process and other factors. So, it is not preferable.

As described above, the average primary particle diameters of hard particles dispersed in the texture of the iron-based sintered alloy material for a valve seat according to the present invention are 5 to 20 μm for the first hard particle and 20 to 150 μm for the second hard particle. That is, it can be said that an average primary particle diameter of the hard particles used is 5 to 150 μm. The reason is that because a hard particle having an average primary particle diameter less than 5 μm is too fine, diffusion into an iron-based sintered alloy matrix may tends to occur to disappear in a sintering process and may fail to provide strengthening effect, i.e. no expected effect of the hard particle by particle dispersion. So, it is not preferable. In contrast, in When a hard particle having a particle diameter equal to or larger than 150 μm, the hard particle dispersed in the iron-based sintered alloy material texture is too large, and when the iron-based sintered alloy material is used as a valve seat, cracking and chipping of the particle may tends to occur and the opposite aggressivility to a valve face is increased. So, it is not preferable.

The condition 3 is: a mixed hard particle obtained by mixing the two types of hard particles, a first hard particle and a second hard particle, a particle size distribution curve measured by laser diffraction scattering analysis has N peaks (N is an integer equal to or larger than 2) and when particle diameters corresponding to the peak top positions are denoted as $D_{T1}$ to $D_{TN}$, a peak top particle diameter difference between at least one neighboring $D_{Tn-1}$ and $D_{Tn}$ ($|D_{Tn-1}-D_{Tn}|$: n is an integer equal to or larger than 2 and equal to or smaller than N) is preferable to be in the range of 15 to 100 μm in neighboring $D_{Tn-1}$ and $D_{Tn}$. The iron-based sintered alloy material for a valve seat according to the present invention is characterized in that the mixed hard particle used has a particle size distribution curve measured by laser diffraction scattering analysis has N peaks (N is an integer equal to or larger than 2) and when particle diameters corresponding to the peak top positions are denoted as $D_{T1}$ to $D_{TN}$, a peak top particle diameter difference between at least one neighboring $D_{Tn-1}$ and $D_{Tn}$ ($|D_{T-1}-D_{Tn}|$: n is an integer equal to or larger than 2 and equal to or smaller than N) is preferable to be in the range of 15 to 100 μm in neighboring $D_{Tn-1}$ and $D_{Tn}$ (hereinafter, the "a peak top particle diameter difference between $D_{Tn-1}$ and $D_{Tn}$ ($|D_{Tn-1}-D_{Tn}|$: n is an integer equal to or larger than 2 and equal to or smaller than N)" is referred to as "a peak top particle diameter difference"). Here, when the peak top particle diameter difference is less than 15 μm, the difference in particle diameter between the hard particles is small. In such a case, using of hard particles of two different particle diameters is made meaningless, and result difficulty in obtaining of an iron-based sintered alloy material improved in both strength and machinability required for a valve seat material, and also difficult to achieve the improvement in the wear resistance and the reduction of the opposite aggressivility to a valve face when the iron-based sintered alloy material is used as a valve seat. So, it is not preferable. In contrast, in when the peak top particle diameter difference exceeds 100 μm, the amount of a large hard particle is too much and the opposite aggressivility to a valve face is made severe. Further, since a homogeneous dispersion state of the hard particle in a texture of an iron-based sintered alloy material can hardly be obtained to make both the mechanical strength and toughness poor, i.e. it is not preferable to use such iron-based sintered alloy material as a valve seat.

In when the particle size distribution curve has three or more peak tops, any one of the particle diameter differences between neighboring peak tops is preferable to be in the range of 15 μm to 100 μm. If any one of particle diameter differences between neighboring peak tops satisfies the requirement in such a way, for the above-mentioned reason, all of improvement in the wear resistance, the reduction of the opposite aggressivility to a valve face and improvement in the mechanical strength can be achieved when the iron-based sintered alloy material is used as a valve seat. So, it is preferable.

The condition 4 is: in a texture of an iron-based sintered alloy material, the total area ratio occupied by both of the first hard particle and the second hard particle constituting the mixed hard particle in the texture of the iron-based sintered alloy is preferable to be 10 to 60% by area. In when the total area ratio is less than 10% by area, since the amount of the hard particle contained in the texture of the iron-based sintered alloy material is made small to result poor wear resistance, i.e. the using of the hard particle is made meaningless. So, it is not preferable. In contrast, in When the total area ratio exceeds 60% by area, since the amount of the hard particle contained in the texture of the iron-based sintered alloy material is too much and it results poor workability, toughness and impact resistance required for a valve seat material, and the opposite aggressivility to a valve face is made severe. So, it is not preferable. That is, the hard particles contained in an iron-based sintered alloy material can provide a valve seat having a more stabilized quality when the total area ratio occupied by both of the first hard particle and the second hard particle is made to be in the above-mentioned range.

In the total area ratio of hard particles in the condition 4 described above, it is more preferable that the area ratio occupied by one of a first hard particle and a second hard particle is 2 to 40% by area in the total area ratio, and the lest area ratio occupied by other of a first hard particle and a second hard particle is a value obtained by subtracting the area ratio occupied by one of a first hard particle and a second hard particle from the total area ratio. When the area ratio of one hard particle is less than 2% by area, just the same result when one type of the hard particles is used is provided, and it makes improvement in both the strength and machinability required for a valve seat material hard and also makes difficult to achieve the improvement in the wear resistance and the reduction of the opposite aggressivility to a valve face when the iron-based sintered alloy material is used as the valve seat. So, it is not preferable. In contrast, when the area ratio of one hard particle thereof exceeds 40% by area and the area ratio of the other hard particle is 2% by area, which is the lower limit, just the same result as that in when one type of the hard particles is used might be provided as described above. So, it is not preferable. That is, the first hard particle and the second hard particle dispersed in well balance and not unevenly in a texture of an iron-based sintered alloy material can prevent the poor wear resistance which is brought about when just the first hard particle is used and prevent the opposite aggressivility and the poor mechanical strength which are brought about when just the second hard particle is used and it enables to provide a valve seat having a more stabilized quality.

As for a method for manufacturing an iron-based sintered alloy material in which two types of a hard particle, a first hard particle and a second hard particle are dispersed, there is no especial limitation and any popular powder metallurgy method can be employed.

In the iron-based sintered alloy material for a valve seat according to the present invention, the first hard particle and the second hard particle constituting the mixed hard particle are preferable to be a hard particle having a Vickers Hardness in the range of 650HV0.1 to 1100HV0.1. When the Vickers Hardness of the hard particles is less than 650HV0.1, it may make the wear resistance of an iron-based sintered alloy material used as a valve seat poor not to achieve a long life as an internal combustion engine. So, it is not preferable. In contrast, when the hardness of the hard particles exceeds 1100HV0.1, the toughness of an iron-based sintered alloy material is made poor and the iron-based sintered alloy material is made brittle to result poor impact resistance performance to impact. So, it is not preferable.

In addition, the difference in Vickers Hardness between two types of hard particles dispersed in an iron-based sintered alloy material is preferable to be in the range of 300HV0.1 to 350HV0.1 in some cases depending on the material of the hard particles. Here, when two types of hard particles having the same hardness are used and are dispersed in the texture of an iron-based sintered alloy material used as a valve seat is considered. The hard particles having a high hardness may improve the wear resistance of a valve seat itself. However, since the machinability when the iron-based sintered alloy is worked to the valve seat is made poor and the opposite aggressivility to a valve face of the valve seat cannot be reduced, i.e. the quality as a valve seat cannot be maintained in well balance. In contrast, the hard particles having a low hardness can reduce the opposite aggressivility to a valve face of a valve seat. However, since the wear resistance of the valve seat is made poor and the machinability when the iron-based sintered alloy is worked to the valve seat is made poor in some cases, i.e. the quality as a valve seat material cannot be maintained in well balance. Therefore, using of just the hard particle having an intermediate hardness can be considered, but it is difficult to obtain an iron-based sintered alloy material improved in both the strength and machinability required as a valve seat material. In addition, it is also difficult to achieve the improvement in the wear resistance when the iron-based sintered alloy material is used as a valve seat and the reduction of the opposite aggressivility to a valve face. So in some cases, it is preferable to provide a certain hardness difference between a first hard particle and a second hard particle depending on the materials of the hard particles.

In the iron-based sintered alloy material for a valve seat according to the present invention, the first hard particle and the second hard particle constituting a mixed hard particle preferably comprise any one composition of cobalt-based intermetallic compound composition 1, cobalt-based intermetallic compound composition 2, and an iron-based intermetallic compound composition, described below. That is, two types of hard particles used in the iron-based sintered alloy material for a valve seat according to the present invention are combination of a cobalt-based intermetallic compound particle and/or an iron-based intermetallic compound particle. The cobalt-based intermetallic compound particle is not made soft at a high temperature, hard to wear, and has a high corrosion resistance. The iron-based intermetallic compound particle is inferior in the diffusion into a matrix of an iron-based sintered alloy material to make the bond ability with the matrix inferior to the cobalt-based intermetallic compound particle. However, the inferiority can be made minimum when the blend of the iron-based intermetallic compound composition is arranged, and has particularly an advantage of being inexpensive.

In the cobalt-based intermetallic compound composition 1, the silicon content is 0.5 to 4.0% by weight, the chromium content is 5.0 to 20.0% by weight, the molybdenum content is 20.0 to 40.0% by weight and the balance is cobalt and inevitable impurities. The compound in which these components mutually form an intermetallic compound is referred to as a cobalt-based intermetallic compound. In the cobalt-based intermetallic compound composition 2, the silicon content is 0 to 4.0% by weight, the nickel content is 5.0 to 20.0% by weight, the chromium content is 15.0 to 35.0% by weight, the molybdenum content is 15.0 to 35.0% by weight and the balance is cobalt and inevitable impurities. Employing such composition patterns can improve a solid lubricating performance of the hard particles.

It is preferable because the improvement in characteristics of the wear resistance, mechanical strength and machinability of an iron-based sintered alloy material obtained by dispersing the hard particle can be achieved when a cobalt-based intermetallic compound having a composition described above is employed for a hard particle.

In the iron-based intermetallic compound composition, the cobalt content is 10.0 to 20.0% by weight, the nickel content is 2.0 to 20.0% by weight, the chromium content is 12.0 to 35.0% by weight, the molybdenum content is 12.0 to 35.0% by weight and the balance is iron and inevitable impurities. The compound in which these components mutually form an intermetallic compound is referred to as an iron-based intermetallic compound. Employing such a composition pattern can improve a solid lubricating performance of the hard particle.

It is preferable because the improvement in characteristics of the wear resistance, mechanical strength and machinability of an iron-based sintered alloy material obtained by dispersing the hard particle can be achieved when an iron-based intermetallic compound having a composition described above is employed for a hard particle. In addition, because the iron-based intermetallic compound is less expensive than the cobalt-based intermetallic compound, when the iron-based intermetallic compound is applied for a hard particle dispersed in an iron-based sintered alloy material, a valve seat of an internal combustion engine excellent in cost performance can be provided.

Then, the texture of an iron-based sintered alloy material will be described. The "matrix" used in the description below refers to texture of an iron-based sintered alloy material excluding a cobalt-based hard particle, a solid lubricant and pores formed between particles dispersed in the texture. The iron-based sintered alloy material for a valve seat according to the present invention is preferable to contain two or more alloying constituents selected from carbon, silicon, chromium, molybdenum, cobalt, nickel, copper, tungsten and vanadium, in the range of 13.0 to 90.0% by weight in the texture. Hereinafter, each alloying constituent will be described briefly.

Carbon as an alloying constituent precipitates as a fine carbon particle to improve the solid lubricating performance, or functions as an aid to forms carbide substances or an intermetallic compound among iron and an alloy element described below to improve the wear resistance in an iron matrix. In this case, the carbon content in an iron matrix is preferable to be 0.5 to 2.0% by weight. When the carbon content is less than 0.5% by weight, preferable carbide substances may not be formed in an iron matrix to hardly improve solid lubricating performance, wear resistance and mechanical strength by the carbide formation. So, it is not preferable. In contrast, when the carbon content exceeds 2.0% by weight, a martensite texture is made increase, the amount of hard and brittle cementite ($Fe_3C$) is made excessive, and the amount of carbide substances formed between the carbon and another alloying constituent is made excessive to make the iron matrix brittle. That is, the impact resistance performance as an iron-based sintered alloy material is made poor and the durability and a good machinability are lost. So, it is not preferable.

The silicon content in an iron matrix is preferable to be 0.2 to 3.0% by weight. When the silicon content is less than 0.2% by weight, a preferable intermetallic compound cannot be formed. So, it is not preferable. In contrast, when the silicon content exceeds 3.0% by weight, the amount of hard and brittle carbide substances in the iron matrix is made excessive to make the matrix brittle. That is, the impact resistance performance as an iron-based sintered alloy material is made poor and the durability and a good machinability are lost. So, it is not preferable.

Chromium as an alloying constituent is an element to form chromium carbide to improve heat resistance, corrosion resistance and wear resistance. The chromium content in an iron matrix is preferable to be 0.5 to 4.0% by weight. When the chromium content is less than 0.5% by weight, any of the heat resistance, corrosion resistance and wear resistance may not be improved. So, it is not preferable. In contrast, when the chromium content exceeds 4.0% by weight, excessive formation of chromium carbide makes the chromium carbide segregates on particle boundaries and it makes the iron matrix hard and brittle. That is, the impact resistance performance and a good machinability are lost. So, it is not preferable.

Molybdenum as an alloying constituent forms molybdenum carbide to improve the solid lubricating performance and/or forms an iron-molybdenum intermetallic compound which improves the wear resistance and the temper softening resistance in an iron matrix. The molybdenum content in the iron matrix is preferable to be 0.2 to 5.0% by weight. When the molybdenum content is less than 0.2% by weight, a small amount of molybdenum carbide formed hardly improve the wear resistance. So, it is not preferable. In contrast, when the molybdenum content exceeds 5.0% by weight, the formation of molybdenum carbide and an iron-molybdenum intermetallic compound is made excessive. As a result, the iron matrix is made hard and brittle to result poor machinability. So, it is not preferable.

Cobalt as an alloying constituent existing together with tungsten carbide greatly improves the mechanical strength and heat resistance of an iron-based sintered alloy. In addition, the homogeneous diffusion of other alloy elements is promoted and the wear resistance is enhanced also. The cobalt content in an iron matrix is preferable to be 0.5 to 6.0% by weight. When the cobalt content is less than 0.5% by weight, any of heat resistance, corrosion resistance and wear resistance may not be improved. So, it is not preferable. In contrast, when the cobalt content exceeds 6.0% by weight, the effect of the addition exceeding the content is already saturated and the excessive addition is not economical. So, it is not preferable.

Nickel as an alloying constituent provides the heat resistance to an iron matrix, and improve the wear resistance. The nickel content in the iron matrix is preferable to be 0.4 to 5.0% by weight. When the nickel content is less than 0.4% by weight, the heat resistance may not be provided to the iron matrix. So, it is not preferable. In contrast, when the nickel content exceeds 5.0% by weight, the nickel addition exceeding the content is already saturated on improvement of the heat resistance. In contrast, the machinability as an iron-based sintered alloy material is made poor according to the high hardness. So, it is not preferable.

Copper as an alloying constituent forms a solid solution in an iron matrix to make the texture of an iron-based sintered alloy fine. The copper content in the iron matrix is preferable to be 0.5 to 3.0% by weight. When the copper content is less than 0.5% by weight, the effect to make the texture fine may not be provided and the wear resistance may not be improved. So, it is not preferable. In contrast, when the copper content exceeds 3.0% by weight, excessive metal copper tends to precipitate on particle boundaries and/or between the hard particles. So, it is not preferable.

Tungsten forms a tungsten carbide with carbon to improve the wear resistance. The tungsten content in an iron matrix is preferable to be 0.1 to 1.0% by weight. When the tungsten content is less than 0.1% by weight, a carbide substance may not be formed in an iron-based sintered alloy to fail improvement of the wear resistance. So, it is not preferable. In contrast, when the tungsten content exceeds 1.0% by weight, the amount of carbide substances formed with carbon is made excessive and the matrix is made brittle. That is, the impact resistance performance as an iron-based sintered alloy material is made poor and the opposite aggressivility to a valve face is made severe. So, it is not preferable.

Vanadium forms carbide substances in an iron matrix to improve the wear resistance and exhibits a precipitation hardening effect by the vanadium carbide at the same time. The vanadium content in the iron matrix is preferable to be 0.1 to 1.0% by weight. When the vanadium content is less than 0.1% by weight, improvement of the wear resistance and mechanical strength by formation of the carbide substances may not be achieved. So, it is not preferable. In contrast, when the vanadium content exceeds 1.0% by weight, formation of the vanadium carbide is made to be excessive to make the iron matrix hard and brittle. That is, the impact resistance performance as an iron-based sintered alloy material is made poor and a good machinability are lost. So, it is not preferable.

As shown in Table 3, the composition of carbon, silicon, chromium, molybdenum, cobalt, nickel, copper, tungsten and vanadium contained in the texture of the iron-based sintered alloy material for a valve seat according to the present invention is preferably: the carbon content is 1.0 to 1.3% by weight; the silicon content is 0.0 to 2.1% by weight; the chromium content is 1.0 to 19.0% by weight; the molybdenum content is 3.0 to 20.0% by weight; the cobalt content is 4.0 to 32.0% by weight; the nickel content is 0.0 to 9.0% by weight; the copper content is 0.0 to 2.0% by weight; the tungsten content is 0.0 to 2.0% by weight; and the vanadium content is 0.0 to 0.5% by weight. The reason why the proportions of the contents for chromium, molybdenum, cobalt and nickel are large is the diffusion of the elements contained in a first hard particle and a second hard particle into the texture of the iron-based sintered alloy material. In contrast, the proportions of the contents for carbon, silicon, copper, vanadium and the like in the texture are made small because hard particles and the like which do not contain these elements are contained in the texture of the iron-based sintered alloy material.

The iron-based sintered alloy material is preferable to contain two or more alloying constituents selectively used from the alloying constituents having been described above in the range of 13.0 to 90.0% by weight in the texture. Because the alloy obtained from the blending condition according to the present invention have a relatively high hardness, when the amount of the two or more alloying constituents contained in addition to a pure iron powder is less than 13.0% by weight, the mechanical strength of an iron-based sintered alloy material is made decreases to result poor wear resistance of a valve seat. So, it is not preferable. In contrast, when the amount of the two or more alloying constituents contained in addition to a pure iron powder exceeds 90.0% by weight, the mechanical strength of the iron-based sintered alloy material is made too high to make the iron-based sintered alloy material brittle. In addition, when the iron-based sintered alloy is used for a valve seat, the opposite aggressivility to a valve face is made severe. So, it is not preferable.

The iron-based sintered alloy material for a valve seat according to the present invention is preferable that the texture of the iron-based sintered alloy material comprises a solid lubricant powder of a sulfide or a fluoride in the range of 0.2 to 5.0% by area against to 100% by area of the area ratio occupied by a first hard particle, a second hard particle and a matrix. When the content of the solid lubricant powder is less than 0.2% by area, the function as a solid lubricant may not be sufficiently performed to result adhesion between a valve seat and a valve face. So, it is not preferable. In contrast, when the content of the solid lubricant powder exceeds 5.0% by area, the effect of the addition exceeding the content may not be achieved and is meaningless in economical point of view. So, it is not preferable. Further, for example, when a manganese sulfide particle and/or a calcium fluoride particle are used as solid lubricant particles, no diffusion occur in sintering because of high melting points. In addition, they make scuff resistance and wear resistance excellent even in a high temperature operation. So, they are preferable.

The valve seat of an internal combustion engine according to the present invention is characterized in that it is manufactured by using an iron-based sintered alloy material for a valve seat. The valve seat of an internal combustion engine according to the present invention is preferable to improve the airtight in a combustion chamber when a valve is seated because a good worked surface is formed in machining working when it is manufactured by using the iron-based sintered alloy material for a valve seat described above. Further, a sufficient wear resistance and mechanical strength as a valve seat can make the response to the requirement of a long life as an internal combustion engine possible. So, it is preferable.

Examples

The present invention will be described in detail with reference of Examples in the present invention.

In Examples of the iron-based sintered alloy material for a valve seat according to the present invention, Samples 1 to 29 having different blend conditions of powder were prepared as shown in Table 1. Table 2 shows compositions, Vickers hardnesses and particle diameters of hard particles, and compositions of alloy steel powders used in Samples 1 to 29. As for the hard particles, a cobalt-based intermetallic compounds comprising silicon, chromium, molybdenum, and a balance of cobalt and inevitable impurities, or comprising silicon, nickel, chromium, molybdenum, and a balance of cobalt and inevitable impurities, and an iron-based intermetallic compound comprising cobalt, nickel, chromium, molybdenum, and a balance of iron and inevitable impurities were used. The hardnesses of the hard particles were 700HV0.1 for hard particles A, E, H and M, 1050HV0.1 for hard particles B, C, F, I, J and N, 750HV0.1 for hard particles D, K and L, and 900HV0.1 for hard particles S and T as shown in Table 2. Particle diameters of first hard particles used were in the range of 5 μm to 20 μm, and particle diameters of second hard particles used were in the range of 20 μm to 150 μm.

TABLE 1

| | | | | | | | First hard particle | | | Second hard particle | | | Peak top particle | | | | |
|---|---|---|---|---|---|---|---|---|---|---|---|---|---|---|---|---|---|
| | | Pure iron powder | Alloy steel powder | | Additive powder | | | | Particle diameter | | | Particle diameter | diameter difference | Solid lubricant | | Area ratio of hard particle | Area ratio of solid lubricant |
| | Sample | (wt %) | Type | wt % | Type | wt % | Type | wt % | (μm) | Type | wt % | (μm) | (μm) | Type | wt % | A + B (% by area) | (% by area) |
| Examples | 1 | 85.0 | — | 0.0 | C: 1.2 | 1.2 | A | 6.9 | 6.0 | H | 6.9 | 23.0 | 17.0 | — | 0.0 | 12.0 | 0.0 |
| | 2 | 83.7 | — | 0.0 | C: 1.3 | 1.3 | B | 6.9 | 10.0 | I | 8.1 | 26.0 | 16.0 | — | 0.0 | 13.0 | 0.0 |
| | 3 | 83.8 | — | 0.0 | C: 1.2 | 1.2 | C | 8.1 | 12.0 | J | 6.9 | 100.0 | 88.0 | — | 0.0 | 13.0 | 0.0 |
| | 4 | 43.6 | — | 0.0 | C: 1.2 | 1.2 | D | 27.6 | 7.0 | N | 27.6 | 50.0 | 43.0 | — | 0.0 | 48.0 | 0.0 |
| | 5 | 39.0 | — | 0.0 | C: 1.2 | 1.2 | A | 28.8 | 6.0 | H | 31.1 | 23.0 | 17.0 | — | 0.0 | 52.0 | 0.0 |
| | 6 | 47.1 | — | 0.0 | C: 1.1 | 1.1 | A | 6.9 | 6.0 | I | 44.9 | 26.0 | 20.0 | — | 0.0 | 45.0 | 0.0 |
| | 7 | 47.2 | — | 0.0 | C: 1.0 | 1.0 | C | 44.9 | 12.0 | N | 6.9 | 50.0 | 38.0 | — | 0.0 | 45.0 | 0.0 |
| | 8 | 33.4 | — | 0.0 | C: 1.0 | 1.0 | D | 32.2 | 7.0 | J | 33.4 | 100.0 | 93.0 | — | 0.0 | 57.0 | 0.0 |
| | 9 | 44.7 | — | 0.0 | C: 1.0, Ni: 1.5, Cu: 1.0 | 3.5 | E | 28.8 | 15.0 | K | 23.0 | 31.0 | 16.0 | — | 0.0 | 45.0 | 0.0 |
| | 10 | 43.9 | — | 0.0 | C: 1.0, Ni: 1.5, Cu: 1.5, Mo: 1.5 | 5.5 | B | 21.9 | 10.0 | M | 28.8 | 50.0 | 40.0 | — | 0.0 | 44.0 | 0.0 |
| | 11 | 45.0 | — | 0.0 | C: 1.0, Ni: 1.5, Cu: 1.5, Co: 1.5 | 5.5 | E | 23.0 | 15.0 | M | 26.5 | 50.0 | 35.0 | MnS | 1.0 | 43.0 | 1.2 |
| | 12 | 0.0 | P | 58.5 | C: 1.2 | 1.2 | C | 23.0 | 12.0 | N | 17.3 | 50.0 | 38.0 | — | 0.0 | 35.0 | 0.0 |
| | 13 | 0.0 | Q | 62.2 | C: 1.0 | 1.0 | E | 16.1 | 15.0 | L | 20.7 | 103.0 | 88.0 | — | 0.0 | 32.0 | 0.0 |
| | 14 | 39.9 | R | 20.0 | C: 1.0 | 1.0 | D | 13.8 | 7.0 | L | 25.3 | 103.0 | 96.0 | — | 0.0 | 34.0 | 0.0 |
| | 15 | 0.0 | P | 55.0 | C: 1.2, Ni: 1.5, Cu: 2.0 | 4.7 | C | 23.0 | 12.0 | N | 17.3 | 50.0 | 38.0 | — | 0.0 | 35.0 | 0.0 |
| | 16 | 47.8 | R | 15.0 | C: 1.0, Co: 2.0, Ni: 1.0, Cu: 1.0 | 5.0 | B | 20.7 | 10.0 | N | 11.5 | 50.0 | 40.0 | — | 0.0 | 28.0 | 0.0 |
| | 17 | 32.3 | P | 30.0 | C: 1.0, Co: 3.0, Ni: 1.5 | 5.5 | F | 20.7 | 16.0 | N | 11.5 | 50.0 | 34.0 | — | 0.0 | 28.0 | 0.0 |
| | 18 | 45.0 | — | 0.0 | C: 1.0, Ni: 1.5, Cu: 1.5, Co: 1.5 | 5.5 | E | 23.0 | 15.0 | M | 26.5 | 50.0 | 35.0 | — | 0.0 | 43.0 | 0.0 |
| | 19 | 43.6 | — | 0.0 | C: 1.2 | 1.2 | D | 27.6 | 7.0 | K | 27.6 | 31.0 | 24.0 | MnS | 0.2 | 48.0 | 0.4 |
| | 20 | 43.6 | — | 0.0 | C: 1.2 | 1.2 | D | 27.6 | 7.0 | L | 27.6 | 103.0 | 96.0 | CaF2 | 2.9 | 48.0 | 4.8 |
| | 21 | 44.7 | — | 0.0 | C: 1.0, Ni: 1.5, Cu: 1.0 | 3.5 | F | 28.8 | 16.0 | N | 23.0 | 50.0 | 34.0 | MnS | 0.6 | 45.0 | 1.0 |
| | 22 | 0.0 | Q | 62.2 | C: 1.0 | 1.0 | A | 16.1 | 6.0 | K | 20.7 | 31.0 | 25.0 | CaF2 | 0.6 | 32.0 | 1.0 |
| | 23 | 47.8 | R | 15.0 | C: 1.0, Co: 2.0, Ni: 1.0, Cu: 1.0 | 5.0 | E | 20.7 | 15.0 | N | 11.5 | 50.0 | 35.0 | CaF2 | 1.2 | 28.0 | 2.0 |
| | 24 | 68.9 | Q | 10.0 | C: 1.0, Co: 2.0, Ni: 1.0, Cu: 1.0 | 5.0 | S | 8.1 | 10.0 | T | 8.1 | 50.0 | 40.0 | — | 0.0 | 14.0 | 0.0 |
| | 25 | 67.4 | — | 0.0 | C: 1.0, Co: 2.0, Ni: 1.0, Cu: 1.0 | 5.0 | S | 17.3 | 10.0 | I | 10.4 | 26.0 | 16.0 | MnS | 0.6 | 24.0 | 1.0 |
| | 26 | 80.4 | — | 0.0 | C: 1.2 | 1.2 | A | 11.5 | 6.0 | T | 6.9 | 50.0 | 44.0 | — | 0.0 | 16.0 | 0.0 |
| | 27 | 67.4 | — | 0.0 | C: 1.0, Co: 2.0, Ni: 1.0, Cu: 1.0 | 5.0 | D | 11.5 | 7.0 | T | 16.1 | 50.0 | 43.0 | MnS | 0.6 | 24.0 | 1.0 |
| | 28 | 49.3 | — | 0.0 | C: 1.2, Ni: 1.5, Cu: 2.0 | 4.7 | S | 28.8 | 10.0 | L | 17.3 | 103.0 | 93.0 | MnS | 0.6 | 40.0 | 1.0 |
| | 29 | 35.5 | — | 0.0 | C: 1.2 | 1.2 | S | 34.5 | 10.0 | T | 28.8 | 50.0 | 40.0 | MnS | 1.2 | 55.0 | 2.0 |

Additive powders, hard particles (first hard particles and second hard particles), and solid lubricants were blended to a pure iron powder and/or alloy iron powders as a main constituents in predetermined combinations and proportions (% by weight) as shown in Table 1. The blend proportions are the ratio against to 100% by weight which is sum of the weights, a first hard particle, a second hard particle and a matrix in the texture of the iron-based sintered alloy material. In Table 1, the particle diameter differences of peak tops in the mixed powders of a first hard particle and a second hard particle are also disclosed. The iron-based sintered alloy material for a valve seat according to the present invention was prepared by, mixing of each powder according to conditions shown in Tables 1 and 2, filling of the mixed powder in a metal mould, compression moulding of the filled powder by a moulding press followed by sintering. The differences in hardness between the first hard particles and the second hard particles were 50HV0.1 for Samples 9, 13 and 22, 150HV0.1 for Samples 25, 27 and 28, 200HV0.1 for Sample 26, 300HV0.1 for Samples 4, 6 and 8, and 350HV0.1 for Samples 10 and 23. The differences in hardness between the first hard particles and the second hard particles were 0HV0.1 for the other Samples.

size distribution by utilizing a scattering pattern of light obtained when a laser is irradiated on a mass of hard particle powder.

Next, a method for determining a peak top particle diameter difference from a particle size distribution of a mixed hard particle of a first hard particle and a second hard particle will be described using FIG. 1 to FIG. 3. FIG. 1 shows a particle size distribution curve of a hard particle A having an average particle diameter of 7.3 μm. In the particle size distribution curve shown in FIG. 1, one peak top can be confirmed at a position of a particle diameter about 8 μm. Then, FIG. 2 shows a particle size distribution curve of a hard particle B having an average particle diameter of 91.5 μm. In the particle size distribution curve shown in FIG. 2, one peak top can be confirmed at a position of particle diameter about 90 μm. FIG. 3 shows a particle size distribution curve of a mixed powder obtained by mixing each of the hard particles A and the hard particles B to be 50%. As shown in FIG. 3, the average particle diameter of the mixed particle of the hard particle A and the hard particle B is 55.3 μm, and when the mixed powder of the hard particle A and the hard particle B is measured by the laser diffraction scattering analysis, two peak tops can be confirmed. In the particle size distribution

TABLE 2

| | Type | Composition pattern | Hardness (HV0.1) | Particle diameter (μm) |
|---|---|---|---|---|
| First hard particle powder | A | 9.0Cr—30.0Mo—3.0Si-Bal•Co-based intermetallic compound particle | 700 | 6 |
| | B | 10.0Ni—25.0Cr—25.0Mo-Bal•Co-based intermetallic compound particle | 1050 | 10 |
| | C | 10.0Ni—25.0Cr—25.0Mo-Bal•Co-based intermetallic compound particle | 1050 | 12 |
| | D | 15.0Cr—32.0Mo—3.4Si-Bal•Co-based intermetallic compound particle | 750 | 7 |
| | E | 9.0Cr—30.0Mo—3.0Si-Bal•Co-based intermetallic compound particle | 700 | 15 |
| | F | 10.0Ni—25.0Cr—25.0Mo-Bal•Co-based intermetallic compound particle | 1050 | 16 |
| | S | 15.0Co—4.0Ni—16.0Cr—15.0Mo-Bal•Fe-based intermetallic compound particle | 900 | 10 |
| Second hard particle powder | H | 9.0Cr—30.0Mo—3.0Si-Bal•Co-based intermetallic compound particle | 700 | 23 |
| | I | 10.0Ni—25.0Cr—25.0Mo-Bal•Co-based intermetallic compound particle | 1050 | 26 |
| | J | 10.0Ni—25.0Cr—25.0Mo-Bal•Co-based intermetallic compound particle | 1050 | 100 |
| | K | 15.0Cr—32.0Mo—3.4Si-Bal•Co-based intermetallic compound particle | 750 | 31 |
| | L | 15.0Cr—32.0Mo—3.4Si-Bal•Co-based intermetallic compound particle | 750 | 103 |
| | M | 9.0Cr—30.0Mo—3.0Si-Bal•Co-based intermetallic compound particle | 700 | 50 |
| | N | 10.0Ni—25.0Cr—25.0Mo-Bal•Co-based intermetallic compound particle | 1050 | 50 |
| | T | 15.0Co—4.0Ni—16.0Cr—15.0Mo-Bal•Fe-based intermetallic compound particle | 900 | 50 |
| Alloy steel powder | P | 3.0Cr—0.2Mo-Bal•Fe | — | — |
| | Q | 4.0Ni—1.5Cu—0.5Mo-Bal•Fe | — | — |
| | R | 4Cr—5.0Mo—6.0W—2.0V-Bal•Fe | — | — |
| First hard particle powder (used only in Comparative Example) | G | 60.0Mo-Bal•Fe particle | 1200 | 13 |
| Second hard particle powder (used only in Comparative Example) | O | 60.0Mo-Bal•Fe particle | 1200 | 29 |

Further, the proportions of a hard particle and a solid lubricant contained in the iron-based sintered alloy material prepared in the Examples indicated in an area ratio are shown in Table 1. The area ratio is indicated against to 100% by area which is a texture area of the iron-based sintered alloy material containing the hard particles.

In the iron-based sintered alloy for a valve seat according to the present invention, a mixed hard particle of two types, a first hard particle and a second hard particle having different particle diameters are dispersed in the texture as described above. In a particle size distribution curve obtained when the first hard particle and the second hard particle were mixed and the mixed hard particle is measured by laser diffraction scattering analysis, some peaks may be found. The laser diffraction scattering analysis is a method for measuring a particle curve, a particle diameter difference in peak top positions between a particle diameter (about 8 μm) corresponding to the peak top position of a particle size distribution curve of the hard particle A and a particle diameter (about 90 μm) corresponding to the peak top position of a particle size distribution curve of the hard particle B, i.e. a peak top particle diameter difference is about 82 μm. It makes that the peak top particle diameter difference obtained from the mixed particle of the hard particle A and the hard particle B exists in the range of 15 μm to 100 μm, which is a requirement of the present invention. As disclosed in an example described above, when a peak top particle diameter difference in a mixed particle of two types of hard particles exists in the range of 15 μm to 100 μm, the porosity distribution in an iron-based sintered alloy is stabilized in a suitable range to improve the wear resistance, mechanical strength and machinability of an iron-based sintered alloy material in well balance.

Based on the descriptions above, peak top particle diameter differences in mixed powders of two types of hard particles contained in Examples will be investigated. The data on peak top particle diameter differences in particle size distribution curves of mixed powders of first hard particles and second hard particles for Samples of Examples are shown in Table 1. The peak top particle diameter differences in Samples 1 to 29 were all in the range of 15 μm to 100 μm as shown in Table 1.

Table 3 shows compositions of iron-based sintered alloy materials of Samples 1 to 29. The composition of iron-based sintered alloy material in iron-based sintered alloy materials shown in Table 3 for carbon, silicon, chromium, molybdenum, cobalt, nickel, copper, tungsten and vanadium are indicated as a proportion against to 100% by weight of sum texture containing iron as a balance.

TABLE 3

| | Composition of iron-based sintered alloy material (wt %) | | | | | | | | | | SUM |
|---|---|---|---|---|---|---|---|---|---|---|---|
| Sample | C | Si | Cr | Mo | Co | Ni | Cu | W | V | Fe | (wt %) |
| 1 | 1.20 | 0.41 | 1.24 | 4.14 | 8.00 | 0.00 | 0.00 | 0.00 | 0.00 | 85.00 | 100.0 |
| 2 | 1.30 | 0.00 | 3.75 | 3.75 | 6.00 | 1.50 | 0.00 | 0.00 | 0.00 | 83.70 | 100.0 |
| 3 | 1.20 | 0.00 | 3.75 | 3.75 | 6.00 | 1.50 | 0.00 | 0.00 | 0.00 | 83.80 | 100.0 |
| 4 | 1.20 | 0.94 | 11.04 | 15.73 | 24.73 | 2.76 | 0.00 | 0.00 | 0.00 | 43.60 | 100.0 |
| 5 | 1.20 | 1.80 | 5.39 | 17.97 | 34.74 | 0.00 | 0.00 | 0.00 | 0.00 | 38.90 | 100.0 |
| 6 | 1.10 | 0.21 | 11.85 | 13.30 | 21.96 | 4.49 | 0.00 | 0.00 | 0.00 | 47.10 | 100.0 |
| 7 | 1.00 | 0.00 | 12.95 | 12.95 | 20.72 | 5.18 | 0.00 | 0.00 | 0.00 | 47.20 | 100.0 |
| 8 | 1.00 | 1.09 | 13.18 | 18.65 | 29.33 | 3.34 | 0.00 | 0.00 | 0.00 | 33.40 | 100.0 |
| 9 | 1.00 | 1.65 | 6.04 | 16.00 | 28.11 | 1.50 | 1.00 | 0.00 | 0.00 | 44.70 | 100.0 |
| 10 | 1.00 | 0.86 | 8.07 | 15.62 | 25.46 | 3.69 | 1.50 | 0.00 | 0.00 | 43.80 | 100.0 |
| 11 | 1.00 | 1.49 | 4.46 | 14.85 | 30.21 | 1.50 | 1.50 | 0.00 | 0.00 | 45.00 | 100.0 |
| 12 | 1.20 | 0.00 | 11.83 | 10.19 | 16.12 | 4.03 | 0.00 | 0.00 | 0.00 | 56.63 | 100.0 |
| 13 | 1.00 | 1.19 | 4.55 | 11.77 | 19.61 | 2.49 | 0.93 | 0.00 | 0.00 | 58.47 | 100.0 |
| 14 | 1.00 | 1.33 | 6.67 | 13.51 | 19.39 | 0.00 | 0.00 | 1.20 | 0.40 | 56.50 | 100.0 |
| 15 | 1.20 | 0.00 | 11.73 | 10.19 | 16.12 | 5.53 | 2.00 | 0.00 | 0.00 | 53.24 | 100.0 |
| 16 | 1.00 | 0.00 | 8.65 | 8.80 | 14.88 | 4.22 | 1.00 | 0.90 | 0.30 | 60.25 | 100.0 |
| 17 | 1.00 | 0.00 | 8.95 | 8.11 | 15.88 | 4.72 | 0.00 | 0.00 | 0.00 | 61.34 | 100.0 |
| 18 | 1.00 | 1.49 | 4.46 | 14.85 | 30.21 | 1.50 | 1.50 | 0.00 | 0.00 | 45.00 | 100.0 |
| 19 | 1.20 | 1.88 | 8.28 | 17.66 | 27.38 | 0.00 | 0.00 | 0.00 | 0.00 | 43.60 | 100.0 |
| 20 | 1.20 | 1.88 | 8.28 | 17.66 | 27.38 | 0.00 | 0.00 | 0.00 | 0.00 | 43.60 | 100.0 |
| 21 | 1.00 | 0.00 | 12.95 | 12.95 | 20.72 | 6.68 | 1.00 | 0.00 | 0.00 | 44.70 | 100.0 |
| 22 | 1.00 | 1.19 | 4.55 | 11.77 | 19.61 | 2.49 | 0.93 | 0.00 | 0.00 | 58.47 | 100.0 |
| 23 | 1.00 | 0.62 | 5.34 | 9.84 | 18.61 | 2.15 | 1.00 | 0.90 | 0.30 | 60.25 | 100.0 |
| 24 | 1.00 | 0.00 | 2.59 | 2.48 | 4.43 | 2.05 | 1.15 | 0.00 | 0.00 | 86.30 | 100.0 |
| 25 | 1.00 | 0.00 | 5.37 | 5.20 | 8.76 | 2.73 | 1.00 | 0.00 | 0.00 | 75.95 | 100.0 |
| 26 | 1.20 | 0.35 | 2.14 | 4.49 | 7.71 | 0.28 | 0.00 | 0.00 | 0.00 | 83.85 | 100.0 |
| 27 | 1.00 | 0.39 | 4.30 | 6.10 | 10.12 | 1.64 | 1.00 | 0.00 | 0.00 | 75.45 | 100.0 |
| 28 | 1.20 | 0.59 | 7.20 | 9.86 | 12.90 | 2.65 | 2.00 | 0.00 | 0.00 | 63.60 | 100.0 |
| 29 | 1.20 | 0.00 | 10.13 | 9.50 | 9.50 | 2.53 | 0.00 | 0.00 | 0.00 | 67.15 | 100.0 |

Comparative Examples

Next, Comparative Examples against the present invention will be described.

In Comparative Examples against the iron-based sintered alloy material for a valve seat according to the present invention, Samples 24 to 38 having different blend conditions of powders were prepared as shown in Table 4. Compositions, Vickers hardnesses and particle diameters of hard particles and compositions of alloy steel powders used in Samples 30 to 38 are shown in Table 2. As for the hard particles, a cobalt-based intermetallic compound comprising compositions of silicon, chromium, molybdenum, and a balance of cobalt and inevitable impurities, or silicon, nickel, chromium, molybdenum, and a balance of cobalt and inevitable impurities, and an iron-based intermetallic compound comprising composition of cobalt, nickel, chromium, molybdenum, and a balance of iron and inevitable impurities, and a ferromolybdenum (Fe—Mo) in addition were used. The ferromolybdenum (Fe—Mo) particles having compositional patterns of hard particles G and O disclosed in Table 2 are different from the compositional patterns of the other hard particles in containing no chromium and no cobalt. The ferromolybdenum (Fe—Mo) particles having compositional patterns of hard particles G and O had a Vickers Hardness of 1200HV0.1 as shown in Table 2, which is out of the range specified in the present invention.

TABLE 4

| | | | | | | | | | First hard particle | | |
|---|---|---|---|---|---|---|---|---|---|---|---|
| | | Pure iron powder | Alloy steel powder | | Additive powder | | | | | | Particle diameter |
| | Sample | (wt %) | Type | wt % | Type | wt % | Type | wt % | | | (μm) |
| Comparative Examples | 30 | 89.6 | — | 0.0 | C: 1.2 | 1.2 | A | 4.6 | | | 6.0 |
| | 31 | 27.5 | — | 0.0 | C: 1.2 | 1.2 | G | 27.6 | | | 13.0 |
| | 32 | 27.5 | — | 0.0 | C: 1.2 | 1.2 | G | 27.6 | | | 13.0 |
| | 33 | 2.4 | — | 0.0 | C: 1.0 | 1.0 | B | 48.3 | | | 7.0 |

TABLE 4-continued

| | | | | | | | | |
|---|---|---|---|---|---|---|---|---|
| 34 | 0.0 | P | 16.0 | C: 1.0, Ni: 1.5, Cu: 1.0 | 3.5 | F | 34.5 | 16.0 |
| 35 | 47.8 | R | 15.0 | C: 1.0, Co: 2.0, Ni: 1.0, Cu: 1.0 | 5.0 | B | 20.7 | 10.0 |
| 36 | 39.0 | — | 0.0 | C: 1.2 | 1.2 | E | 28.8 | 16.0 |
| 37 | 83.5 | — | 0.0 | C: 1.0, Co: 2.0, Ni: 1.0, Cu: 1.0 | 5.0 | S | 5.8 | 10.0 |
| 38 | 44.7 | Q | 10.0 | C: 1.0, Co: 2.0, Ni: 1.0, Cu: 1.0 | 5.0 | S | 5.8 | 10.0 |

| | | Second hard particle | | | Peak top particle | Solid lubricant | | Area ratio of | |
|---|---|---|---|---|---|---|---|---|---|
| | Sample | Type | wt % | Particle diameter (μm) | diameter difference (μm) | Type | wt % | hard particle A + B (% by area) | Area ratio of solid lubricant (% by area) |
| Comparative Examples | 30 | H | 4.6 | 23.0 | 17.0 | CaF2 | 0.4 | 8.0 | 0.6 |
| | 31 | O | 43.7 | 29.0 | 16.0 | MnS | 0.2 | 62.0 | 0.4 |
| | 32 | O | 43.7 | 29.0 | 16.0 | — | 0.0 | 62.0 | 0.0 |
| | 33 | I | 48.3 | 26.0 | 19.0 | — | 0.0 | 84.0 | 0.0 |
| | 34 | M | 46.0 | 50.0 | 34.0 | MnS | 3.3 | 70.0 | 5.5 |
| | 35 | I | 11.5 | 23.0 | 13.0 | — | 0.0 | 28.0 | 0.0 |
| | 36 | H | 31.1 | 23.0 | 7.0 | — | 0.0 | 52.0 | 0.0 |
| | 37 | H | 5.8 | 23.0 | 13.0 | MnS | 0.6 | 10.0 | 1.0 |
| | 38 | T | 34.5 | 50.0 | 40.0 | MnS | 0.6 | 65.0 | 1.0 |

In samples 30 to 38, additive powders, hard particles (first hard particles and second hard particles), and solid lubricants were blended to a pure iron powder and/or alloy iron powders as a main constituents in predetermined combinations and proportions (% by weight) as shown in Table 4. The blend proportions are the ratio against to 100% by weight which is sum of the weights, a first hard particle, a second hard particle and a matrix in the texture of the iron-based sintered alloy material. Further in Table 1, the proportions of hard particles and solid lubricants contained in the iron-based sintered alloy material according to the present invention are disclosed in area ratios. The area ratio is indicated against to 100% by area which is a texture area of the iron-based sintered alloy material containing the hard particles. In contrast, in Comparative Examples as shown in Table 4, the total area ratios of the hard particles were 62.0% by area for Samples 31 and 32, 84.0% by area for Sample 33, and 70.0% by area for Sample 34, which were not 60% by area or less, a specified condition of the present invention. A total area ratio of the hard particles of Sample 30 was 8.0% by area, i.e. not 10% by area or more, a specified condition of the present invention. The differences in hardness between the first hard particle and the second hard particle were 350HV0.1 for Sample 34 disclosed in Table 2 are 200HV0.1 for Sample 37 and 0HV0.1 for the other Samples.

The iron-based sintered alloy materials for a valve seat in Comparative Examples were prepared by, mixing of each powder according to conditions shown in Tables 2 and 4, filling of the mixed powder in a metal mould, compression moulding of the filled powder by a moulding press followed by sintering in same condition with Examples.

Next, peak top particle diameter differences of mixed hard particle powders of two types of hard particles contained in Samples of Comparative Examples will be investigated. The data of peak top particle diameter differences in particle size distribution curves of mixed hard particle powders of first hard particles and second hard particles for Samples of Comparative Examples are shown in Table 4. As shown in Table 4, the peak top particle diameter differences were 13.0 μm for Samples 35 and 37, and 7.0 μm for Sample 36, which were not 15 μm or more, a specified condition of the present invention.

The compositions of iron-based sintered alloy materials of Sample 30 to Sample 38 are shown in Table 5. The composition of iron-based sintered alloy material in iron-based sintered alloy materials shown in Table 5 for carbon, silicon, chromium, molybdenum, cobalt, nickel, copper, tungsten and vanadium are indicated as a proportion against to 100% by weight of sum texture containing iron as a balance.

TABLE 5

| | Composition of iron-based sintered alloy material (wt %) | | | | | | | | | | SUM |
|---|---|---|---|---|---|---|---|---|---|---|---|
| Sample | C | Si | Cr | Mo | Co | Ni | Cu | W | V | Fe | (wt %) |
| 30 | 1.20 | 0.28 | 0.83 | 2.76 | 5.34 | 0.00 | 0.00 | 0.00 | 0.00 | 89.60 | 100.0 |
| 31 | 1.20 | 0.00 | 0.00 | 42.78 | 0.00 | 0.00 | 0.00 | 0.00 | 0.00 | 56.02 | 100.0 |
| 32 | 1.20 | 0.00 | 0.00 | 42.78 | 0.00 | 0.00 | 0.00 | 0.00 | 0.00 | 56.02 | 100.0 |
| 33 | 1.00 | 0.00 | 24.15 | 24.15 | 38.64 | 9.66 | 0.00 | 0.00 | 0.00 | 2.40 | 100.0 |
| 34 | 1.00 | 1.38 | 13.25 | 22.46 | 40.48 | 4.95 | 1.00 | 0.00 | 0.00 | 15.49 | 100.0 |
| 35 | 1.00 | 0.00 | 8.65 | 8.80 | 14.88 | 4.22 | 1.00 | 0.90 | 0.30 | 60.25 | 100.0 |
| 36 | 1.20 | 1.80 | 5.39 | 17.97 | 34.74 | 0.00 | 0.00 | 0.00 | 0.00 | 38.90 | 100.0 |
| 37 | 1.00 | 0.17 | 1.45 | 2.61 | 6.23 | 1.23 | 1.00 | 0.00 | 0.00 | 86.30 | 100.0 |
| 38 | 1.00 | 0.00 | 6.45 | 6.10 | 8.05 | 3.01 | 1.15 | 0.00 | 0.00 | 74.25 | 100.0 |

[Comparison Among Examples and Comparative Examples]

The present invention will be described in detail by comparing Examples according to the present invention and Comparative Examples.

Wear amounts of both valve seats and valves as a counterpart in Samples 1 to 38 are shown in FIG. 4. Then, influence of the particle size distributions on mechanical characteristics of the iron-based sintered alloy s will be investigated. In the investigation, particle size distributions of mixed hard particles of two types, first hard particles and second hard particles, dispersed in the texture of iron-based sintered alloy material will be paid attention. The particle diameter differences of neighboring peak tops obtained from the particle size distribution curves for Samples 1 to 29 in Examples shown in Table 1 were all in the range of 15 μm to 100 μm, a specified condition of the present invention. In contrast, the particle diameter differences of neighboring peak tops in the particle size distribution curves for Samples 30 to 38 in Comparative Examples shown in Table 4 were less than 15 μm for Samples 35 to 37, which were out of the range of a specified condition of the present invention. In the case that a particle diameter difference of neighboring peak tops is less than 15 μm, when both hard particles have a small particle diameter, the particles tend to aggregate and the hard particles hardly perform the effect as a hard particle to result poor wear resistance. Next, when both hard particles have a large particle diameter, pores among hard particles are made large, and a phase having a greatly different hardness is scattered in a texture of an iron-based sintered alloy material for a valve seat to result poor wear resistance. As seen in FIG. 4, wear amounts of valve faces and/or valve seats in Samples 35 to 37 are greatly bigger than that of Examples. The reason why may be the differences in characteristics of the mechanical strength and wear resistance between the valve faces and the valve seats caused by the factors described above.

Also as disclosed in Table 4, although peak top particle diameter differences were all in the range of 15 μm to 100 μm for Samples 30 to 34 and 38, a specified condition of the present invention. But the total area ratios occupied by both of the first hard particles and the second hard particles constituting the mixed hard particles were not in the range of 10 to 60% by area in the texture of the iron-based sintered alloy material. As seen in FIG. 4, when the total area ratio of the hard particles was less than 10% by area, the wear resistance of a valve seat tends to be poor as seen in Sample 30. When the total area ratio of the hard particles exceeds 60% by area, the opposite aggressivility to a valve face may be severe as seen in Sample 33, a remarkable example.

FIG. 5 shows radial crushing strengths of iron-based sintered alloy materials for a valve seat of Samples 1 to 38 as relative ratios against to 100% radial crushing strength for Sample 30. As seen in FIG. 5, it can be confirmed that Comparative Examples, particularly Samples 31 to 34 and 38 show lower radial crushing strengths than Examples according to the present invention. The reason why the radial crushing strength of Sample 30 is increased can be estimated that the total area ratio occupied by both of a first hard particle and a second hard particle is small. That is, a proportion of hard particles in the texture of iron-based sintered alloy materials of these Samples 30 and 37 are small. However, as is clearly seen in FIG. 4, the effect for improving the wear resistance by hard particles is not performed, i.e. the wear resistance of a valve seat is made poor.

As disclosed in Table 4, in Samples 31 and 32, Vickers Hardness of both first hard particles and second hard particles of hard particles used exceed 1100HV0.1, a specified condition of the present invention. As a result, the toughness as an iron-based sintered alloy material was made poor and tends to be brittle. That is, the radial crushing strength of Samples 31 and 32 are made poor as seen in FIG. 5.

As disclosed in Tables 1 and 4, iron-based intermetallic compound compositions were applied for hard particles in Samples 24 to 29, 37 and 38. Then, the influences on the wear resistance of a valve seat itself and the opposite aggressivility will be investigated through comparison of an iron-based intermetallic compound composition applied for a hard particle and a cobalt-based intermetallic compound composition applied for a hard particle used. First, just Samples in Examples, Samples 1 to 23 which apply a cobalt-based intermetallic compound composition for hard particles and Samples 24 to 29 which apply an iron-based intermetallic compound composition for a hard particle will be compared. As seen in FIG. 4, Samples 24 to 29 which apply an iron-based intermetallic compound composition for a hard particle show a slightly bigger wear amount in a valve seat. The reason why may be that diffusion capability of an iron-based intermetallic compound particle into a matrix of an iron-based sintered alloy is inferior than that of a cobalt-based intermetallic compound particle and it makes the bond ability with the matrix slightly poor. However, as disclosed in Table 1, when Samples 1 and 24 having the almost same total area ratio of a first hard particle and a second hard particle contained in an iron-based sintered alloy material are compared for example, the difference is very small.

Then, Samples 24 to 29 in Examples which apply an iron-based intermetallic compound composition for a hard particle and Samples 30 to 36 in Comparative Examples which apply a cobalt-based intermetallic compound composition for a hard particle will be compared. As seen in FIG. 4, Samples 30 to 36 in Comparative Examples tend to show poor wear resistance in a valve seat and increased opposite aggressivility than Samples 24 to 29 in Examples. It means that even when an iron-based intermetallic compound composition is applied for a hard particle, influence on the wear resistance of a valve seat and the opposite aggressivility are very small, as long as the composition satisfies the blend condition specified in the present invention.

Also as disclosed in Table 5, Samples 30 and 33 do not satisfy the condition that the iron-based sintered alloy material contains two or more alloying constituents selected from carbon, silicon, chromium, molybdenum, cobalt, nickel, copper, tungsten and vanadium, in the range of 13.0 to 90.0% by weight in the texture. According to the wear amounts in Samples 30 and 33 shown in FIG. 4, it can be recognized that the balances of the wear amount between the valve seat and the valve face is not even. It means that when alloying constituents contained in a texture of an iron-based sintered alloy material are out of the range of 13.0 to 90.0% by weight, both improvement of the wear resistance in a valve seat and reduction of the valve face opposite aggressivility tend to be made difficult. As seen in FIG. 4, since Samples 31 and 32 which used hard particles G and O applying composition patterns containing no nickel and chromium, which makes the mechanical strength increase, the wear resistance of a valve seat made of the Sample is made to be poor when compared to that made of Samples in Examples.

As disclosed in Table 4, Sample 34 contains 5.5% by area of a solid lubricant powder in the texture of the iron-based sintered alloy material, but the area ratio is not in the range of 0.2 to 5.0% by area, a specified condition of the present invention. In this case, as seen in FIG. 5 on Sample 34, when the content of a solid lubricant exceeded 5.0% by area, the radial crushing strength tends to be made poor.

A diagram of the texture of the iron-based sintered alloy material for a valve seat of Sample 1 according to the present invention is shown in FIG. 6, and a diagram of the texture of the iron-based sintered alloy material for a valve seat of Sample 6 is shown in FIG. 7. A diagram of the texture of the iron-based sintered alloy material for a valve seat of Sample 30 in Comparative Example is shown in FIG. 8. Black portions in the Figures indicate a matrix, and are mainly composed of pearlite. White portions in the Figures indicate a first hard particle and second hard particle and a diffusion layer of these hard particles. When Samples 1 and 6 (FIGS. 6 and 7)

according to the present invention, and Sample 30 (FIG. 8) in a Comparative Example are compared, it is made obvious that area for white portions indicating the hard particles including the diffusion layer in the texture of Sample 30 is smaller than that in the textures of Samples 1 and 6 (FIGS. 6 and 7). The reason why such a phenomena is observed in Sample 30 is that the first hard particle and the second hard particle contained in the texture of the iron-based sintered alloy material do not satisfy the blend condition specified in the present invention. When the texture is made to be seen in FIG. 8, i.e. the proportion for the hard particles including diffusion layer, white portions in the texture of the iron-based sintered alloy material is small, a mechanical strength is increased but a wear resistance is made poor. As a result, Sample 30 shows a increased mechanical strength than Sample 1 and Sample 6 according to the present invention (see FIG. 5), but shows a poor wear resistance (see FIG. 4).

The particle diameter of the hard particle according to the present invention described above was determined by using laser diffraction scattering analysis, measuring a maximum diameter of the particles observable in a visual field of 500 μm×500 μm, and calculating the average of maximum diameters measured in five visual fields. The area ratio of the hard particle was determined from the occupied area by the hard particle observed in five visual fields (each 500 μm×500 μm) of each micro-texture. As for the number of samples, sum number in five visual fields is 250 to 500 because 50 to 100 hard particles are observed in one visual field. In addition for measuring software, Win ROOF ver. 5.03 was used.

The hardness of a hard particle is a value measured by using a Micro Vickers Hardness tester (load: 0.1 kgf).

INDUSTRIAL APPLICABILITY

A product excellent in a total balance of the mechanical strength and the machinability as a valve seat without making characteristics including the wear resistance and opposite aggressivility to the valve face which are conventional iron-based sintered alloy materials for a valve seat poor can be provided by using the iron-based sintered alloy material for a valve seat according to the present invention. Therefore, the iron-based sintered alloy material for a valve seat according to the present invention can be applied not only to a valve seat, but also broadly to various types of mechanical parts.

Figure 1:
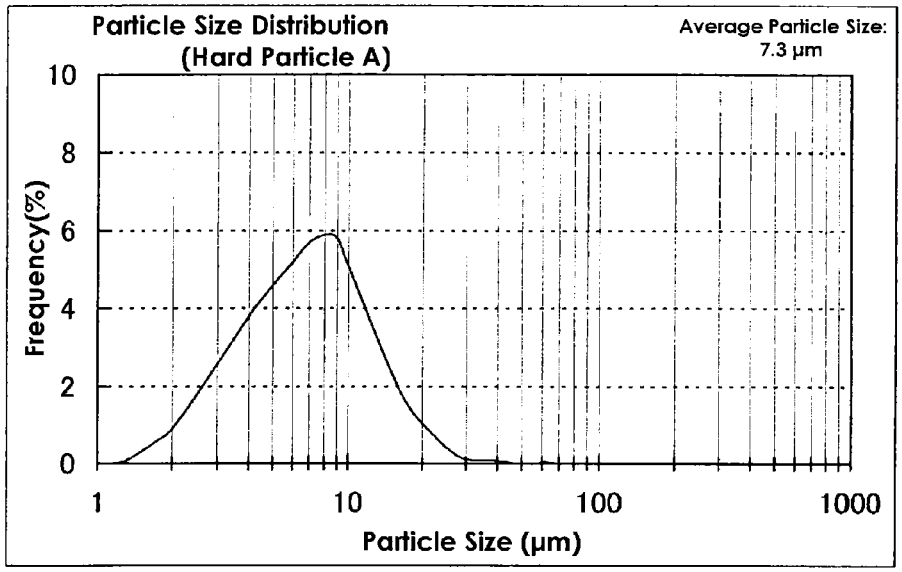
FIG. 1 is a diagram exemplifying a particle size distribution of a first hard particle according to the present invention.
Figure 2:
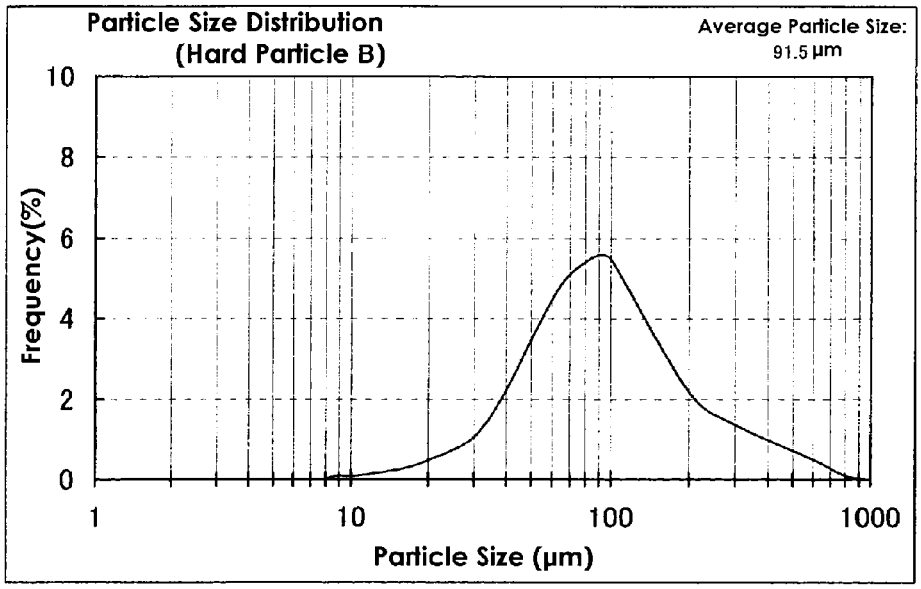
FIG. 2 is a diagram exemplifying a particle size distribution of a second hard particle according to the present invention.
Figure 3:
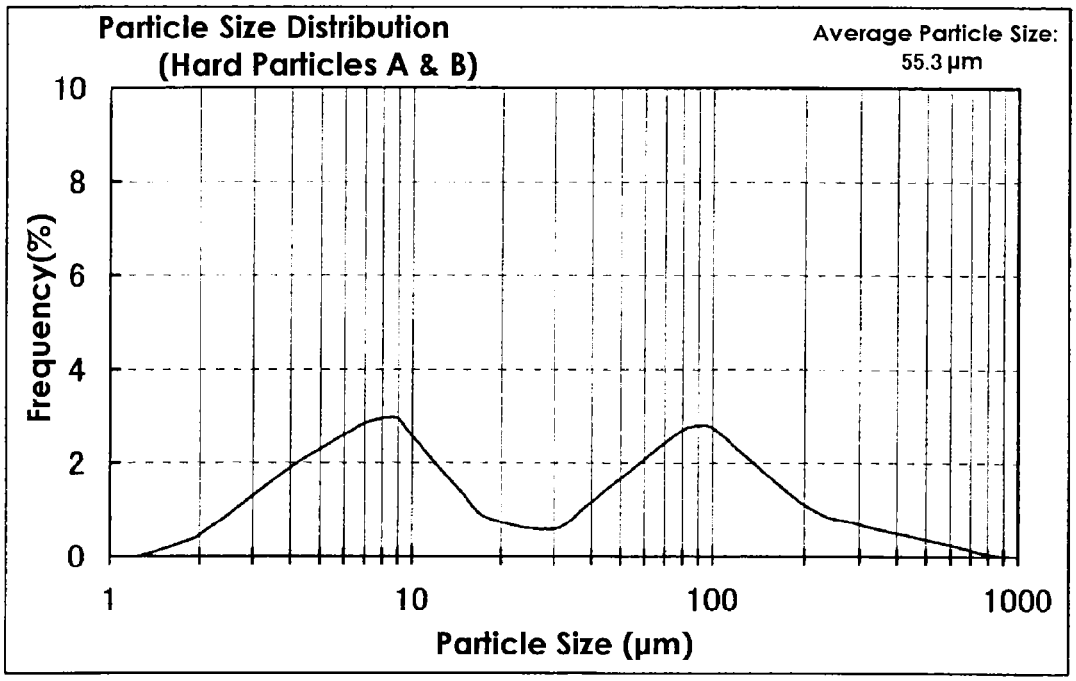
FIG. 3 is a diagram exemplifying a particle size distribution after mixing the first hard particle and the second hard particle according to the present invention.
Figure 4:
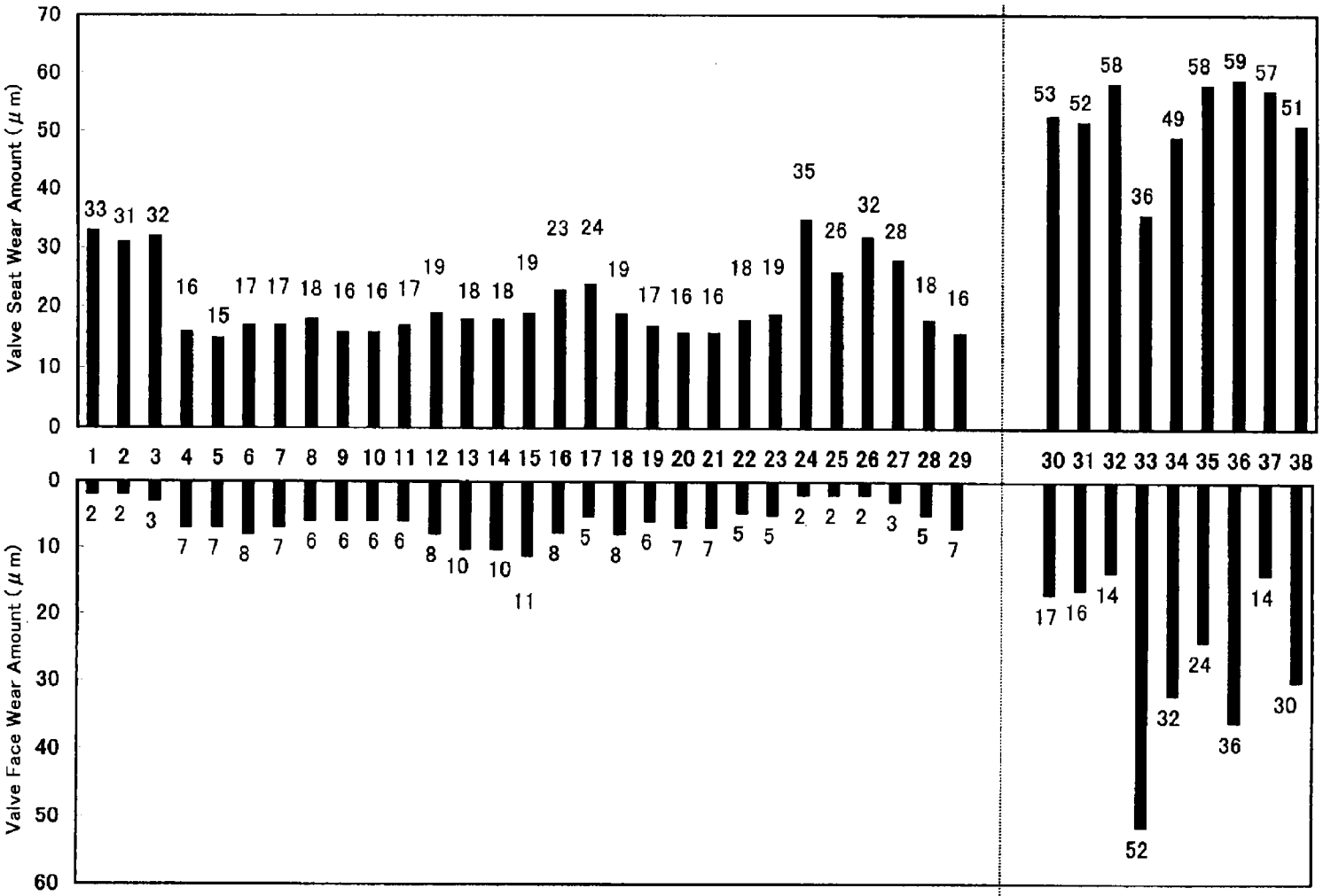
FIG. 4 is a graph showing valve seat wear amounts (μm) and valve face wear amounts (μm) in Examples and Comparative Examples.
Figure 5:
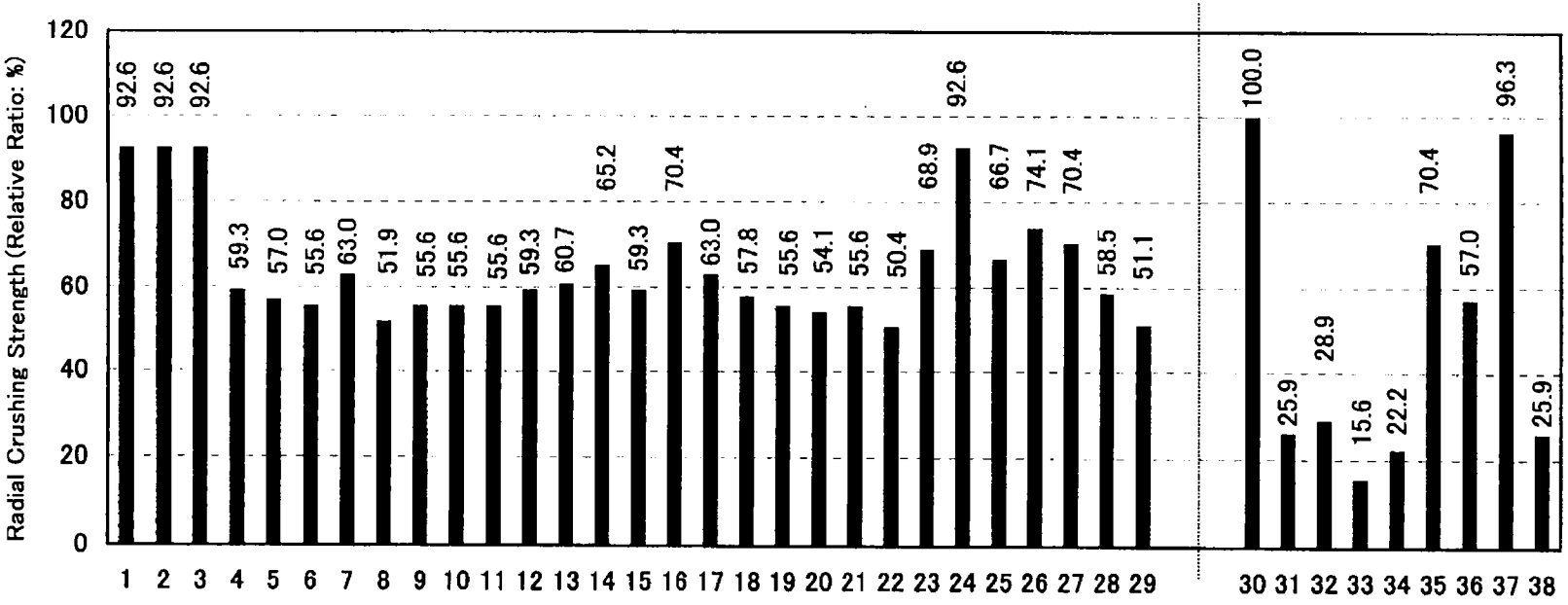
FIG. 5 is a graph showing relative ratios of radial crushing strengths in Examples and Comparative Examples.
Figure 6:
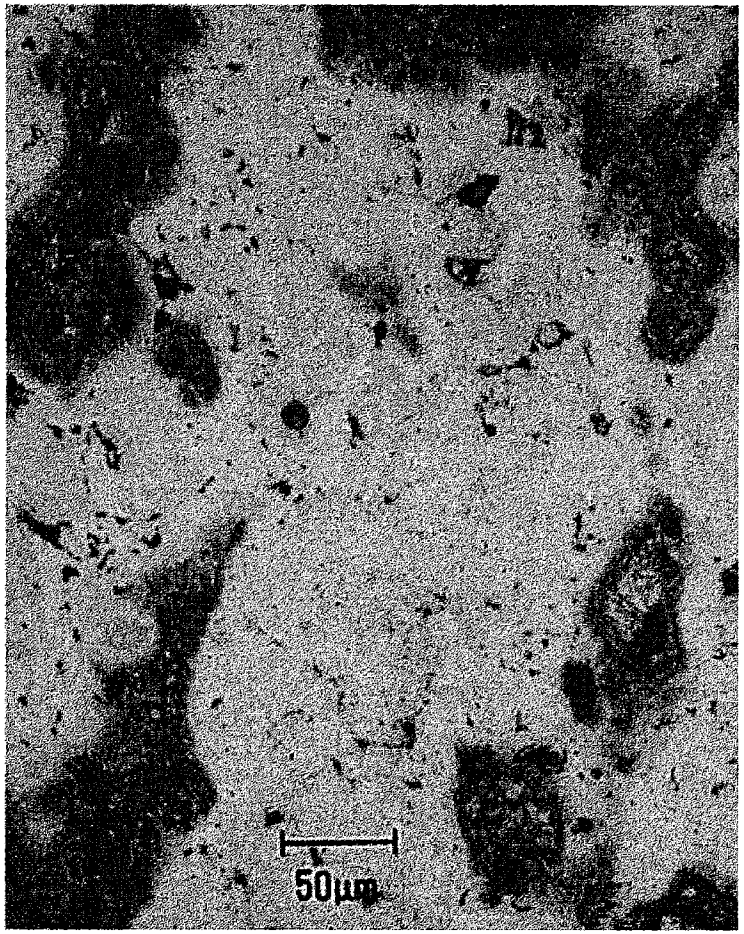
FIG. 6 is a texture diagram of Sample 1 in Examples by a metallurgical microscope.
Figure 7:
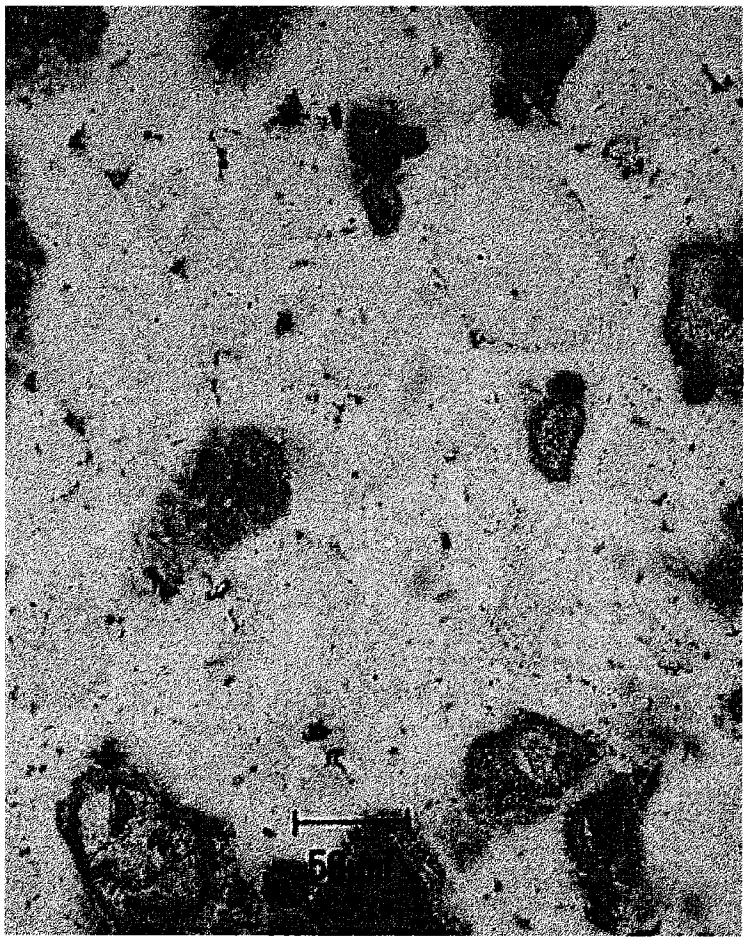
FIG. 7 is a texture diagram of Sample 6 in Examples by a metallurgical microscope.
Figure 8:
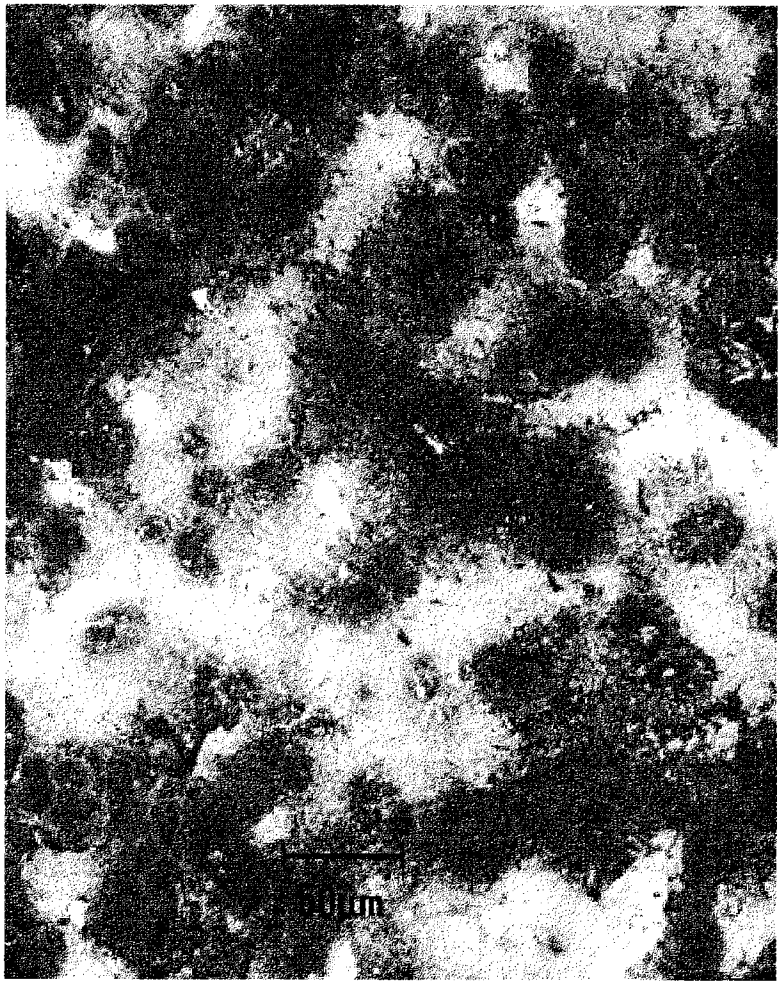
FIG. 8 is a texture diagram of Sample 24 in Comparative Examples by a metallurgical microscope.

The invention claimed is:

1. An iron-based sintered alloy material for a valve seat comprising a first hard particle and a second hard particle dispersed in an iron-based sintered alloy matrix, wherein the first hard particle and the second hard particle have a same hardness with a Vickers Hardness in a range of 650HV0.1 to 1100HV0.1, wherein the first hard particle is different in an average particle diameter from the second hard particle, and wherein the iron-based sintered alloy material for a valve seat satisfies all of Conditions 1 to 4 below:

Condition 1: the first hard particle has an average primary particle diameter of 5 to 20 μm;

Condition 2: the second hard particle has an average primary particle diameter of 20 to 150 μm;

Condition 3: in a mix of a plurality of first hard particles and a plurality of second hard particles, a particle size distribution curve has N peaks (N is an integer equal to or larger than 2) and when particle diameters corresponding to peak top positions are denoted as $D_{T1}$ to $D_{TN}$, a peak top particle diameter difference between at least one neighboring $D_{Tn-1}$ and $D_{Tn}$ ($|D_{Tn-1}-D_{Tn}|$: n is an integer equal to or larger than 2 and equal to or smaller than N) is in a range of 15 to 100 μm; and Condition 4: a total area ratio occupied by the mix in a texture of the iron-based sintered alloy material is 10 to 60% by area.

2. The iron-based sintered alloy material for a valve seat according to claim 1, wherein the first hard particle and the second hard particle comprise any composition selected from cobalt-based intermetallic compound composition 1, cobalt-based intermetallic compound composition 2 and an iron-based intermetallic compound composition below:

Cobalt-based intermetallic compound composition 1:
silicon: 0.5 to 4.0% by weight,
chromium: 5.0 to 20.0% by weight,
molybdenum: 20.0 to 40.0% by weight, and
a balance: cobalt and inevitable impurities;

Cobalt-based intermetallic compound composition 2:
silicon: 0 to 4.0% by weight,
nickel: 5.0 to 20.0% by weight,
chromium: 15.0 to 35.0% by weight,
molybdenum: 15.0 to 35.0% by weight, and
a balance: cobalt and inevitable impurities; and Iron-based intermetallic compound composition:
cobalt: 10.0 to 20.0% by weight,
nickel: 2.0 to 20.0% by weight,
chromium: 12.0 to 35.0% by weight,
molybdenum: 12.0 to 35.0% by weight, and
a balance: iron and inevitable impurities.

3. The iron-based sintered alloy material for a valve seat according to claim 1, wherein the iron-based sintered alloy material contains two or more alloying constituents selected from carbon, silicon, chromium, molybdenum, cobalt, nickel, copper, tungsten and vanadium, in a range of 13.0 to 90.0% by weight in the texture.

4. The iron-based sintered alloy material for a valve seat according to claim 1, wherein the texture of the iron-based sintered alloy material comprises a solid lubricant powder of a sulfide or a fluoride in a range of 0.2 to 5.0% by area against to 100% by area of an area ratio occupied by the mix and the matrix.

5. A valve seat of an internal combustion engine, manufactured by using an iron-based sintered alloy material for a valve seat according to claim 1.

6. An iron-based sintered alloy material for a valve seat, comprising:

first hard particles; and second hard particles;

wherein the first hard particles and the second hard particles have a same hardness with a Vickers Hardness in a range of 650HV0.1 to 1100HV0.1;

wherein the first hard particles are different in an average particle diameter from the second hard particles;

wherein the first hard particles and the second hard particles are dispersed in a matrix;

wherein the first hard particles have a diameter of 5 to 20 μm;

wherein the second hard particles have a diameter of 20 to 150 μm;

wherein a particle size distribution curve for the first hard particles and the second hard particles dispersed in the matrix has N peaks (where N is an integer equal to or larger than 2), wherein particle diameters corresponding to peak top positions on the curve are denoted as $D_{T1}$ to $D_{TN}$, and wherein a peak top particle diameter difference between at least one neighboring $D_{Tn-1}$ and $D_{Tn}$ ($|D_{Tn-1}-D_{Tn}|$: n is an integer equal to or larger than 2 and equal to or smaller than N) is in a range of 15 to 100 μm;

and wherein an area occupied by the first hard particles and the second hard particles is 10 to 60% of an area of the material.

* * * * *